United States Patent [19]

Escallon et al.

[11] Patent Number: 4,749,125

[45] Date of Patent: Jun. 7, 1988

[54] NOZZLE METHOD AND APPARATUS

[75] Inventors: Eduardo C. Escallon, Elwood; Anthony E. Tyner, Alexandria, both of Ind.

[73] Assignee: Terronics Development Corp., Elwood, Ind.

[21] Appl. No.: 3,870

[22] Filed: Jan. 16, 1987

[51] Int. Cl.[4] ..... B05B 5/02; B05B 3/14; B05B 1/00; B67D 3/00

[52] U.S. Cl. ..... 239/3; 239/102.2; 239/552; 239/590.5; 239/598; 239/696; 239/697; 222/485; 222/486

[58] Field of Search ..... 118/626, 629; 427/27, 427/30; 239/3, 102.2, 498, 552, 590, 590.5, 592, 594, 597, 598, 696, 697, 708, 302, 135, 695; 222/485, 486

[56] References Cited

U.S. PATENT DOCUMENTS

| | | | |
|---|---|---|---|
| 1,718,556 | 6/1929 | Harrison | 239/597 X |
| 2,302,289 | 11/1942 | Bramston-Cook | 21/2 |
| 3,577,198 | 5/1971 | Beam | 346/75 |
| 3,698,635 | 10/1972 | Sickles | 239/3 |
| 3,802,625 | 4/1974 | Buser et al. | 239/15 |
| 3,841,557 | 10/1974 | Atkinson | 239/597 X |
| 3,970,192 | 7/1976 | von Wolffradt | 239/597 X |
| 4,004,733 | 1/1977 | Law | 239/3 |
| 4,009,829 | 3/1977 | Sickles | 239/15 |
| 4,095,962 | 6/1978 | Richards | 239/696 X |
| 4,106,697 | 8/1978 | Sickles | 239/15 |
| 4,215,818 | 8/1980 | Hopkinson | 239/3 |
| 4,266,721 | 6/1981 | Sickles | 239/3 |
| 4,341,347 | 7/1982 | DeVittorio | 239/3 |
| 4,476,515 | 10/1984 | Coffee | 361/226 |

FOREIGN PATENT DOCUMENTS

| | | | |
|---|---|---|---|
| 194074 | 9/1986 | European Pat. Off. | 239/696 |
| 216502 | 4/1987 | European Pat. Off. | 239/697 |

OTHER PUBLICATIONS

Exerpt from Western Electric Technical Digest, No. 26, published Apr. 1972, "Nozzles for Adhesive Dispensing Machine".

*Primary Examiner*—Andres Kashnikow
*Assistant Examiner*—Patrick N. Burkhart
*Attorney, Agent, or Firm*—Lundy and Walker

[57] ABSTRACT

A nozzle apparatus and method for electrically charging and dispensing fluids and other flowable materials, comprising a fluid reservoir and a housing. The housing includes walls which define a chamber having an elongated slot at the tip thereof. The slot is resiliently compressible. The reservoir communicates with the chamber such that the fluid is introduced into the chamber at a controlled rate and a low hydrostatic pressure. A shim is placed within the chamber slot partially occluding fluid flow through the slot. The shim and the amount of compression of the slot defines with precision the size and shape of the slot. The shim and fluid are electrically connected to a high voltage source through the housing. The fluid forms a meniscus about the housing slot whereby upon actuation of the high voltage source, the fluid is dispensed as one or more charged fluid paths or a plurality of charged droplets.

58 Claims, 5 Drawing Sheets

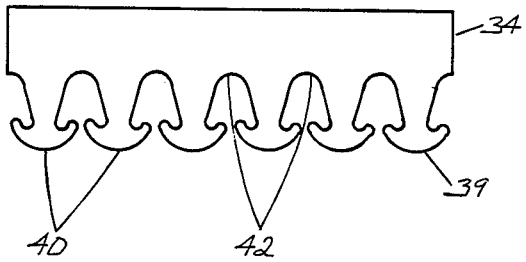
FIG. 4B
FIG. 4C
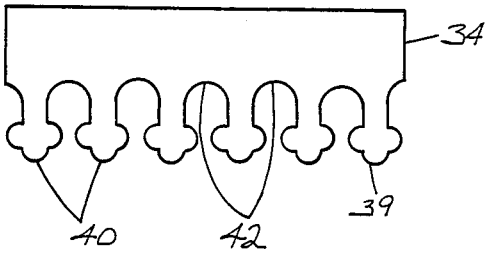
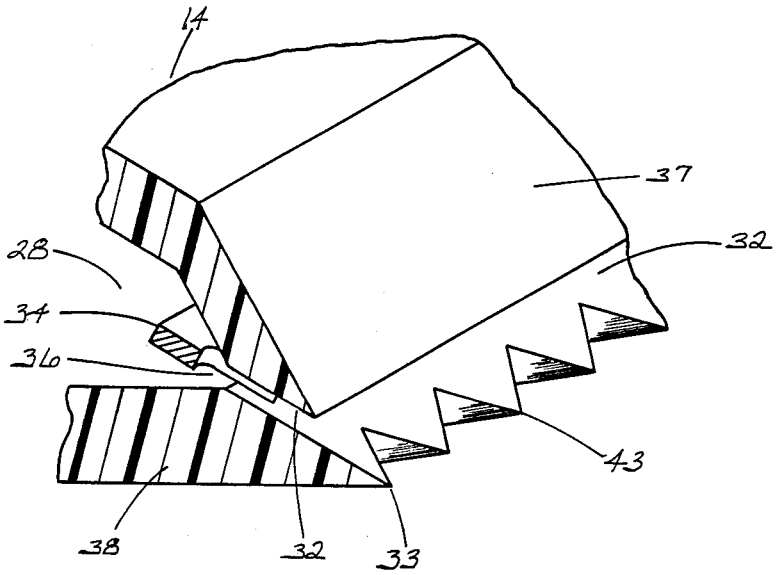
FIG. 7
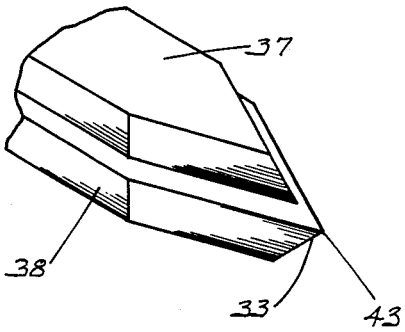
FIG. 8

NOZZLE METHOD AND APPARATUS

BACKGROUND OF THE INVENTION

The subject matter of the invention relates to a nozzle, and more particularly to a nozzle for dispensing liquids and other flowable materials hereinafter called fluids, in a highly controllable fashion through an apparatus that is mechanically simple, dimensionally accurate, operationally efficient and reliable in the form of jets or streams herein called fluid paths or droplets.

Dispensing controllably small quantities of fluid through a nozzle that electrostatically charges the fluid has been heretofore proposed. A typical apparatus might take the form of the corona charging arrangements found in DeVottorio's U.S. Pat. No. 4,341,347, or the induction charging nozzles disclosed in Law's U.S. Pat. No. 4,004,733. Inherent in the geometry of this art is a small dispensing orifice for the fluid, a some mechanical means like the spinning disk of Hopkinson's U.S. Pat. No. 4,215,818, or aerodynamic means as disclosed in Juvinall's U.S. Pat. No. 4,002,777 which finely divides the fluid continuum into droplets.

Problems develop in the aforementioned devices because of the small orifices. The orifices cause considerable difficulty in obtaining reliable function of the nozzle. They have a tendency to become clogged with foreign material, and also encounter high wear due to the abrasive nature of dispensed fluids forced at high local velocities through the orifice. In some processes, the mechanical or aerodynamic dropletization means can be detractive due to either its energy requirement or the creation of excess volume leading to oversprayed material. In all nozzle design application efficiency is important.

The requirement of providing electrical charges to the sprayed liquid creates further complications. A process would ideally provide a high percentage of the theoretical electrostatic charge limit, referred to as the Rayleigh Charge, on what typically may be a wide range of droplet or flow path sizes. This usually involves either conductive liquids or medium resistive liquids, but desirably would include all fluids. The charge has to be applied in a reliable manner taking into consideration aspects of personal safety. Hazards include sparking or arcs in the presence of flammatory solvent-borne materials, including paint, as well as the potential for operator shock. Energy efficiency has also become an important factor.

Another consideration of fluid nozzles is the desire for variability in droplet size, which normally translates into orifice size, and uniformity of droplet size, and control. Difficulties arise in the mechanical fabrication of small orifices. Small holes with any significant bore depth are difficult to fabricate due to the fragility of suitable tools. Consequently, little is found in standard commercial nozzling with orifices smaller than 0.001 inch diameter.

An additional complication is inherent in the class of liquids known as non-Newtonian fluids. With these fluids there is difficulty in obtaining proper acceleration characteristics as the fluid traverses a typical nozzle geometry. This class of fluids, found frequently in the adhesive field, possess viscosity properties that are affected by their local speed, creating loss of fluid uniformity and difficulty in pumping the fluid at conventional pressures. As a consequence, higher pressure of several orders is often necessary to dispense non-Newtonian fluids from typical nozzles.

It is therefore highly desirable to provide an improved electric fluid nozzle.

It is therefore highly desirable to provide an improved fluid nozzle and method which facilitates the dispensing of controlled amounts of fluid in a plurality of fine flow paths or droplets.

It is also highly desirable to provide an improved fluid nozzle and method which allows for a variation of flow.

It is also highly desirable to provide an improved fluid nozzle and method which avoids the problems characteristic of mechanical orifice devices.

It is also highly desirable to provide an improved fluid nozzle which is mechanically simple and inexpensive to manufacture.

It is also highly desirable to provide an improved fluid nozzle and method which is operationally efficient and cost effective.

It is also highly desirable to provide an improved fluid nozzle which is relatively free from frequent clogging caused by foreign material, and suitable for use over a wide range of fluid flow rates.

It is also highly desirable to provide an improved fluid nozzle having electrostatic characteristics such that a high percentage of the theoretical charge limit can be imposed upon the fluid.

It is also highly desirable to provide an improved fluid nozzle and method which provides a preselectable range of droplet sizes to be dispensed over a preselected number of dimensionally stable flow paths.

It is also highly desirable to provide an improved fluid nozzle and method having flow considerations and lends itself to dispensing of both high viscosity and low viscosity fluids, both non-Newtonian and Newtonian materials except for highly conductive and highly resistive fluids.

It is also highly desirable to provide an improved fluid nozzle for dispensing fluid in a highly controllable manner throughout its entire operational range.

It is also highly desirable to provide an improved fluid nozzle having exceptional reliability.

Finally, it is highly desirable to provide an improved fluid nozzle and method having all of the above-mentioned characteristics.

SUMMARY OF THE INVENTION

It is therefore an object of the invention to provide an improved fluid nozzle and method which facilitates the dispensing of controlled amounts of fluid in a plurality of fine flow paths or droplets.

Another object of the invention is to provide an improved fluid nozzle and method which allows for a variation of flow.

Another object of the invention is to provide an improved fluid nozzle and method which avoids the problems characteristic of mechanical orifice devices.

Another object of the invention is to provide an improved fluid nozzle which is mechanically simple and inexpensive to manufacture.

Another object of the invention is to provide an improved fluid nozzle and method which is operationally efficient and cost effective.

Another object of the invention is to provide an improved fluid nozzle which is relatively free from frequent clogging caused by foreign material, and suitable for use over a wide range of fluid flow rates.

Another object of the invention is to provide an improved fluid nozzle having electrostatic characteristics such that a high percentage of the theoretical charge limit can be imposed upon the fluid.

Another object of the invention is to provide an improved fluid nozzle which provides a preselectable range of droplet sizes to be dispensed or a preselected number of dimensionally stable flow paths.

Another object of the invention is to provide an improved fluid nozzle and method having flow considerations, and lends itself to dispensing of both high viscosity and low viscosity fluids, both non-Newtonian and Newtonian materials except for highly conductive and highly resistive fluids.

Another object of the invention is to provide an improved fluid nozzle for dispensing fluid in a highly controllable manner throughout its entire operational range.

Another object of the invention is to provide an improved fluid nozzle having exceptional reliability.

Finally, another object of the invention is to provide an improved fluid nozzle and method having all of the above-mentioned characteristics.

In the broader aspects of the invention, there is provided a nozzle apparatus and method for electrically charging and dispensing fluid and other flowable materials, comprising a fluid reservoir and a housing. The housing includes walls which define a chamber having an elongated slot at the tip thereof. The slot is resiliently compressible. The reservoir communicates with the chamber such that the fluid is introduced into the chamber at a controlled rate and a low hydrostatic pressure. A shim is placed within the chamber slot partially occluding fluid flow through the slot. The shim and the amount of compression of the slot defines with precision the size and shape of the slot. The shim and fluid are electrically connected to a high voltage source through the housing. The fluid forms a meniscus about the housing slot whereby upon actuation of the high voltage source, the fluid is dispensed as one or more charged fluid paths or a plurality of charged droplets.

BRIEF DESCRIPTION OF THE DRAWINGS

The above-mentioned and other features and objects of this invention and the manner of obtaining them will become more apparent and the invention itself will be best understood by reference to the following description of embodiment of the invention taken in conjunction with the accompanying drawings, wherein:

FIG. 7 is a perspective view of the nozzle of the invention having asymmetrical geometry and serrated lips;

FIG. 8 is a perspective view of a single flow path nozzle of the invention with asymmetrical geometry.

DESCRIPTION OF A SPECIFIC EMBODIMENT

Figure 1:
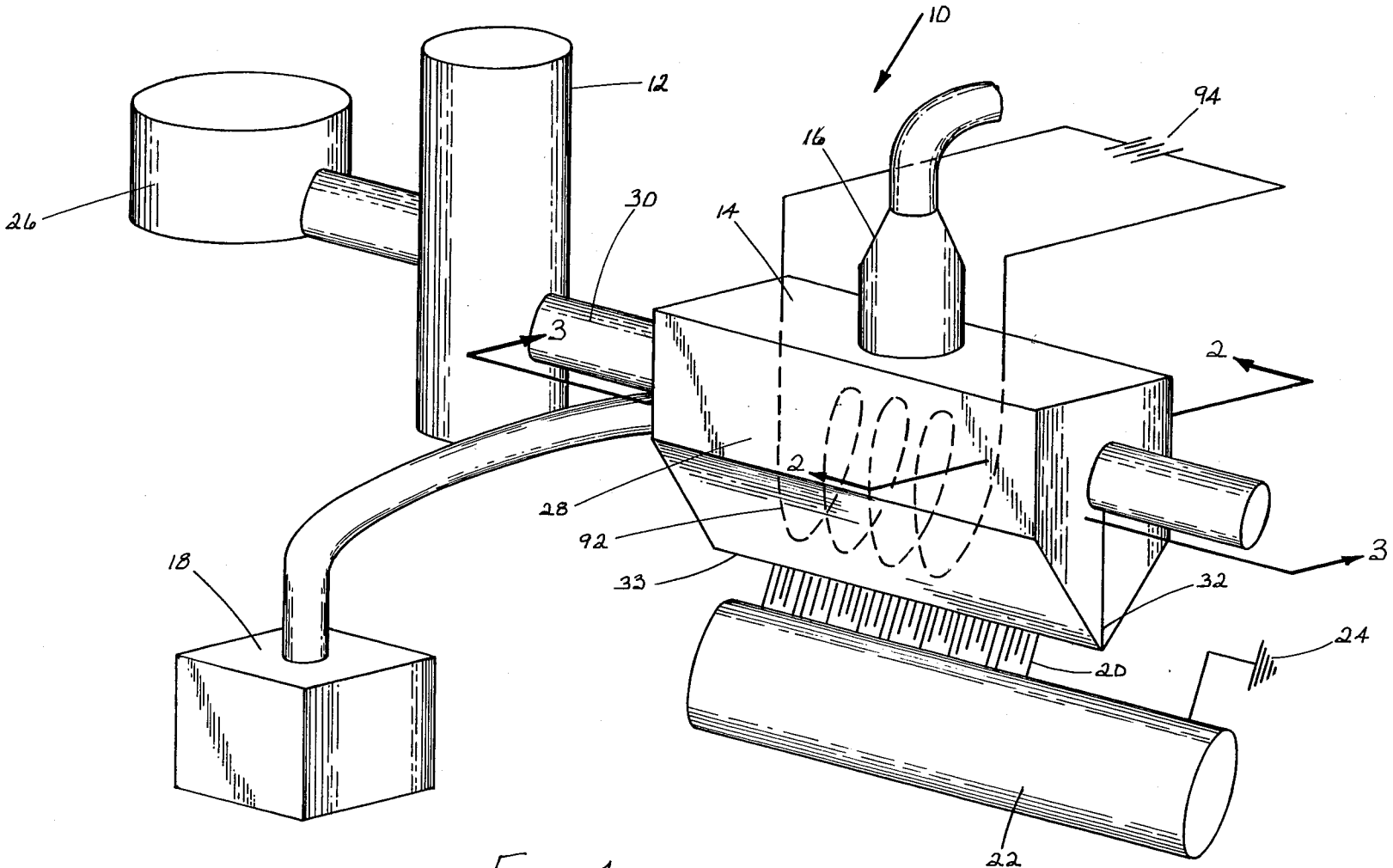
FIG. 1 is a perspective view of the nozzle apparatus of the invention illustrating the nozzle with symmetrical nozzle geometry and smooth lips, the reservoir, the power supply, a target, and a plurality of fluid flow paths.

Referring now to FIG. 1, the nozzle 10 is illustrated comprising fluid reservoir 12, housing 14, high voltage power supply 18, and flow paths 20. In the specific embodiment illustrated, an optional transducer 16 is shown. Target 22 is placed in proximity of the trajectory of fluid paths 20. Target object 22 may be electrically biased and in this embodiment of the invention is grounded by ground line 24.

Hydrostatic means 26 is provided to fluid reservoir 12 such that a selected pressure is maintained within fluid reservoir 12 and within housing 14.

Housing 14 defines chamber 28 which collects fluid from fluid reservoir 12 which is introduced into the chamber via fluid duct 30. Housing 14 is made of electrically insulative material, such as plastic. Housing 14 also defines slot 32 at its tip 33. Hydrostatic means 26 maintains the reservoir fluid and the fluid in the nozzle at a precise pressure. The fluid continuously pressure is never sufficient to force the fluid to flow through slot 32. The liquid fills chamber 28.

Figure 3:
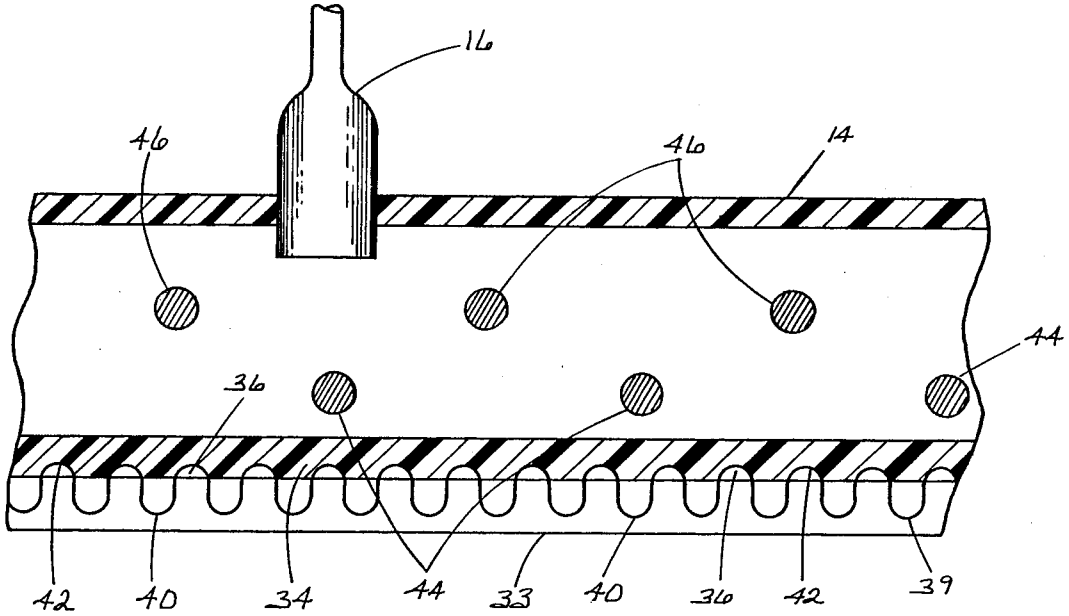
FIG. 3 is a fragmentary cross-sectional view of the housing and chamber of the nozzle showing one embodiment of the nozzle shim taken substantially along section line 3—3 of FIG. 1.
Figure 2:
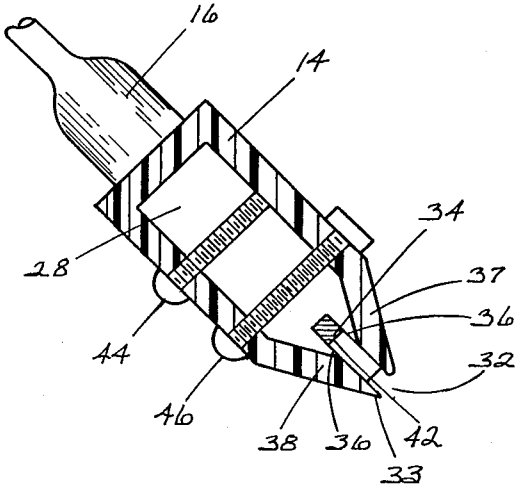
FIG. 2 is a cross-sectional view of the housing and chamber of the nozzle taken substantially along section line 2—2 of FIG. 1.

Referring now to FIGS. 2 and 3, a shim 34 is placed within slot 32 thereby defining with precision chamber openings 36 and the width of slot 32. By selecting a particular shim 34 and the position of the shim 34 in slot 32, the dimensions of slot 32 and openings 36 are selected. The dimensions of slot 32 and openings 36 ultimately control the flow of fluid at a given pressure through the nozzle. The fluid in cavity 28 is in contact with transducer 16 and shim 34 and works its way through openings 36 and between nozzle lips 37 and 38. Shim 34 partially occludes the fluid within chamber 28. Shim 34 is made of conductive material, such as metal. At a selected field strength and a selected shim and a selected shim position, the flow of fluid to the nozzle lips 37 and 38 is a straight line function of the pressure within the housing chamber 28. A different straight line function of fluid flow/pressure can be obtained by increasing the field strength, by increasing the thickness of the shim, or by positioning the shim differently so as to select different sized openings 36. Thus, fluid flow through the nozzle is controllable by the chamber pressure over the entire range of operability. At either end of the operable pressure range, at pressures lower than sufficient to cause uninterrupted flow through the nozzle or at pressures large enough to cause the nozzle to drip, this straight line relationship between fluid flow and pressure does not exist. In a specific embodiment, however the nozzle is operated in a controllable fashion and this relationship does exist over a pressure range of five times the minimum operable pressure.

Figure 4A:
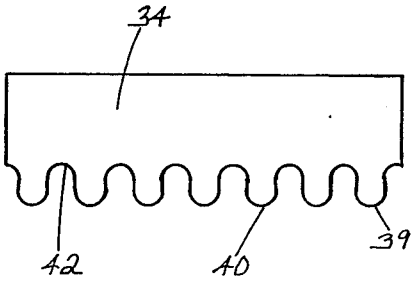
FIG. 4 *a, b,* and *c* are plan views of other embodiments of the nozzle shim.

FIG. 3 shows shim 34 to have a discontinuous edge 39 including crests 40 and valleys 42 which is placed within nozzle slot 32 of housing 14. The discontinuous edge 39 is dimensioned such that it together with slot 32 of housing 14 defines openings 36 at valleys 42 as shown in FIGS. 3 and 4, and allows fluid to flow from chamber 28 through slot 32. In other words, the positioning of shim 34 within nozzle lips 37 and 38 determine the area through which fluid can flow from chamber 28. In specific embodiments, edge 39 can be scalloped or otherwise shaped as shown in FIGS. 3 and 4. In a specific embodiment, scalloped shim 34 has a crest and valley spacing of 0.250 inches and a removal of 0.125 inches of the total 0.700 inch extension. The selection of the shim and the field strength control the rate of flow through the nozzle. FIG. 4 illustrates alternative shim shapes. Each of these includes smoothly rounded distal ends so as not to concentrate the charge at the edge 39.

Housing 14 and lips 37 and 38 are constructed of flexible, resilient, electrically insulative, material, such as acrylic plastic, such that housing 14 can be deformed outwardly by screws 46 or compressed inwardly by screws 48.

The assembly of the nozzle for a given purpose involves selection of a properly dimensioned shim 34, and the insertion of the shim into the nozzle in the position shown in FIGS. 2 and 3. The shim extends longitudinally along housing 14 within slot 32. Screws 46 are loosened, and screws 44 are tightened to bring pressure upon shim 34 and to hold the shim 34 in place between lips 37 and 38. As shown, shim 34 is recessed from tip 33 thereby eliminating the possibility of unintentional contact with it from the exterior during operation enhancing the safety of the nozzle. In a specific embodiment, shim 34 is recessed from lip 37 about 0.050 inches. By the proper selection of shim 34, the flow characteristics of the nozzle are determined as the fluid in cavity 28 flows through opening 36 between nozzle lips 37 and 38 in response to the hydrostatic pressure in reservoir 12 in FIG. 1.

Precision shim 34 is electrically connected to high voltage power supply 18 as illustrated in FIGS. 1 and 4. High voltage from the device is cabled to shim 34 in any conventional manner which would include a conductive screw, bolt or electric connector. In a specific embodiment, a guard, not shown, made of suitable material such as polytetrafloroethylene, covers the high voltage connection to prevent arcing to the target 22.

Figure 5:
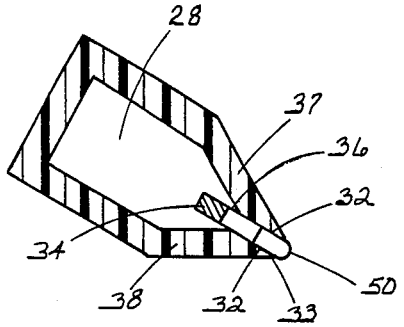
FIG. 5 is a cross-sectional view of the nozzle identical to FIG. 2 illustrating a symmetrical nozzle geometry, smooth lips and convex meniscus formation.
Figure 6:
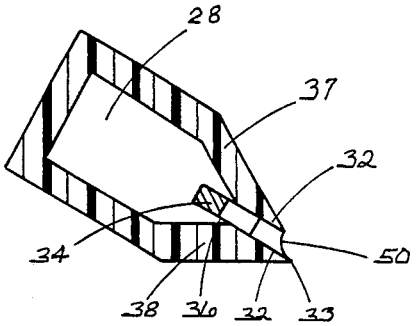
FIG. 6 is a cross-sectional view of an alternative embodiment of the nozzle of the invention similar to FIG. 2 illustrating an asymmetrical nozzle geometry, smooth lips and concave meniscus formation.

Referring now to FIGS. 5 and 6, the flow of fluid into the slot 32 and past the shim 34 positions fluid between the nozzle lips 37 and 38 at the nozzle tip 33. This fluid as shown in FIG. 5 may produce an outwardly protruding meniscus having a generally convex exterior surface. By properly selecting the dimensions of nozzle lips 37 and 38 and the fluid to be dispensed, the geometry of the meniscus 50 can be controlled. For example, referring to FIG. 5, the use of a symmetrical nozzle tip 33 having lips 37 and 38 of approximately the same dimensions and a fluid which forms an outwardly curved meniscus results in controlled operation of the nozzle of the invention, and fluids can be dispensed from the nozzle as afore-described. However, by selecting a fluid which forms a meniscus having a different shape, erratic or noncontrollable flow may result from the same nozzle.

Also, for example, wherein the lip 37 is offset from the nozzle lip 38 and an asymmetrical nozzle lip geometry is chosen, as illustrated in FIG. 6, and a fluid is chosen which forms a concave meniscus, fluid can be dispensed from the nozzle of the invention in a controllable manner as above described. However, if a fluid which forms an outwardly curved or generally convex meniscus with the asymmetric nozzle configuration shown in FIG. 6 is chosen, erratic and noncontrollable fluid flow may be experienced. Thus, by altering the geometrical dimensions of the nozzle lips 37 and 38 and choosing appropriate fluids, the geometry of the meniscus 50 can be altered and the nozzle of the invention can be used to dispense a great variety of fluids in a controllable fashion.

Referring now to FIGS. 1 through 6, a target 22 is located at a preset distance from the nozzle 10. Application of the high voltage to shim 34 creates an electric field between the meniscus 50 and the target 22 causing the meniscus to erupt into a series of fine flow paths 20 as illustrated in FIG. 1. The dimensions of the shim 34, as well as the parameters of the voltage applied and the resistivity of the fluid dictate the diameter of the flow paths 20 formed.

In a specific embodiment, as shown in FIG. 1, nozzle 10 can be heated. Resistive coils 92 imbedded in housing 14 and connected to power source 94 are illustrated in FIG. 1, as an example. Whether or not nozzle 10 is heated in a specific application depends upon the material being dispensed.

Figure 9:
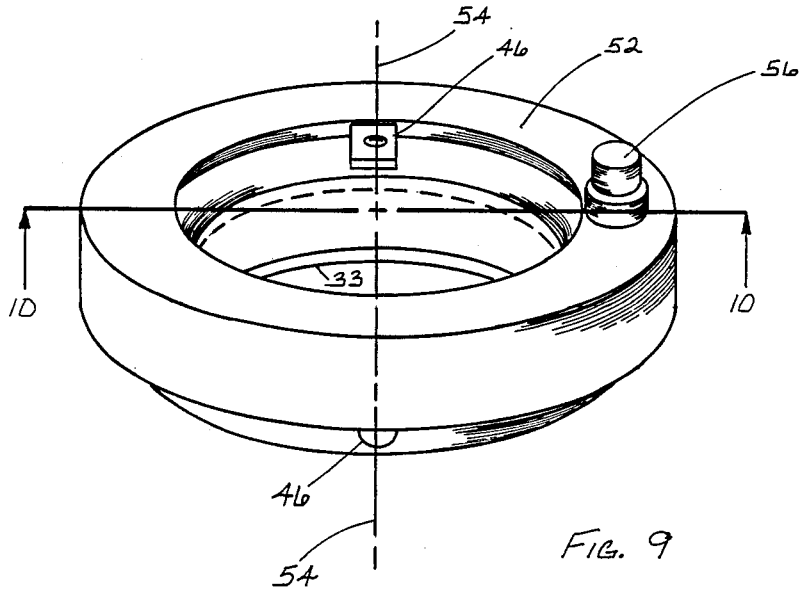
FIG. 9 is a perspective view of an alternative embodiment of the nozzle of the invention.
Figure 10:
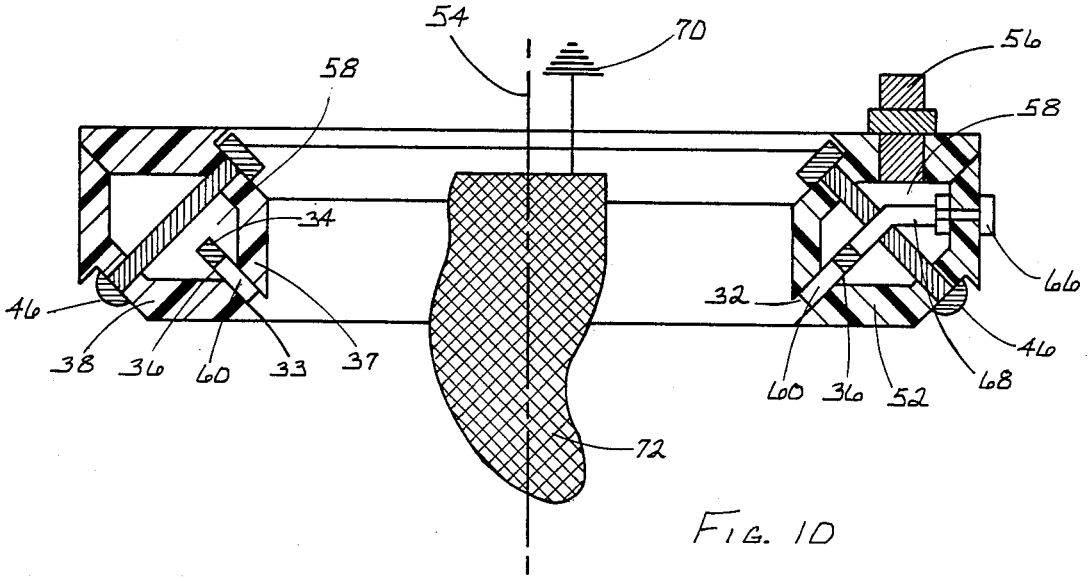
FIG. 10 is a cross-sectional view of the nozzle of FIG. 9 with a target taken substantially along line 10—10 of FIG. 9.

The nozzle of this invention can be of many different geometries. FIGS. 9 and 10 illustrate that housing 14 can be generally circular, as well as linear as shown in FIG. 1. Circular housing 52 contains a circular shim 60 therein coaxial about its axis 54. The lip geometry can be either symmetrical or asymmetrical, and lip 38 of the asymmetrical version can be either smooth or serrated in shape. The liquid to be dispensed enters cavity 58 through port 56. Shim 60 positions the lips 37 and 38 of nozzle 52 at a precise slot dimension and defines the dimensions of openings 36. High voltage enters the terminal 66 attached to shim 60. Target 72 is grounded by connection 70 and can be of an irregular form as illustrated depending upon the specific application. Depending on the application, these target 72 may rotate and/or translate about axis 54 or may be stationary.

The location of the flow paths 20 emanating from the nozzle 20 is dependent upon the concentration of charge at the tip 33 of the nozzle. In the smooth or continous lip versions of the nozzle illustrated in FIGS. 1 through 6, flow paths 20 may occur anywhere along the tip 33 of the nozzle of the invention. In practice, the location of the ligaments along the tip 33 of the nozzle of the invention is erratic and may occur at different positions at different times and the positions of flow paths 20 are not precisely controlled or fixed in position.

FIG. 7 shows an asymmetrical nozzle configuration like that shown in FIG. 6 except for the protruding lip 38 is serrated to form a plurality of charge concentrating peaks 43 spaced along the length of the nozzle 10. A serrated lip 38 as shown in FIG. 7 controllably positions flow paths 20 at the peaks 43 within the operable flow range of the nozzle 10 of the invention. As above mentioned, the fluid flow through the nozzle at a fixed field strength is totally dependent upon the fluid pressure within the housing chamber 28. Thus, the selection of a chamber pressure that provides too much flow to the nozzle lips may cause a misfiring of a flow path 20 between the peaks 43. However, otherwise, each peak will form a flow path 20 in the operation of the nozzle. In specific embodiments, peaks 43 function in this manner to controllably select the positioning of flow paths 20 so long as they are positioned more than about one tenth of an inch apart and are not spaced apart more than about two inches apart, peak to peak.

FIG. 8 illustrates a single flow path nozzle of the invention. In cross-section, the single flow path nozzle of the invention is identical to the nozzle illustrated in FIG. 6. In operation, the single flow path nozzle of the invention produces a single flow path 20 emanating from the apex 43. In essence, single flow path nozzle of the invention is in all other respects the same as the nozzle illustrated in FIG. 7 with a single apex 43. Thus, the maximum apex spacing dimension of the nozzle in a specific embodiment is about two inches and the minimum apex spacing dimension of the nozzle is about one-tenth of an inch.

Thus, it can be appreciated that the present invention can encompass any of a variety of geometries, the important characteristics being the selection of the shim and the placement thereof between the nozzle lips, the selection of the discontinuities of the shim and the nozzle lip geometry. Circular, linear and curved geometries are all contemplated. Single and stacked nozzles are also contemplated.

The performance of the nozzle of the invention in terms of fluid path diameter is proportional to the slot thickness as determined by the thickness of the shim and the number of flow paths per inch as determined by the field strength between the nozzle and the target or free space. Flow path spacing is a function of the field strength between the nozzle and the target, of the fluid pressure within the housing chamber, the fluid flow to the nozzle lips, the nozzle lip shape and the physical properties of the fluid to be dispensed.

The formation of any of the flow paths emerging from the nozzle of the invention afore-mentioned into a plurality of charged droplets may occur in any one of the three methods of the invention. First, dropletization may occur from any of the nozzles afore-disclosed once flow paths have been established by raising the field strength between the nozzle and the target to exceed the theoretical charge limit of the fluid. This results in the necking down of the flow paths at spaced intervals and the formation of a plurality of relatively similarly sized droplets 88 in FIG. 10. Because of the surface tension of the fluid, all flow paths are cylindrical in shape and all droplets become spherical in shape upon formation.

Dropletization may also occur by the provision of the optional transducer 16 shown in the nozzle illustrated in FIG. 1. Transducers 16 can be equipped in any of the nozzles of the invention including those illustrated in FIGS. 1 and 3. By actuation of the transducer 16 after flow paths 20 are formed in parts an ultrasonic wave to the fluid within the nozzle functions to cause the flow paths 20 to 'neck down' at spaced intervals and form a plurality of uniformly sized charged droplets.

Figure 11:
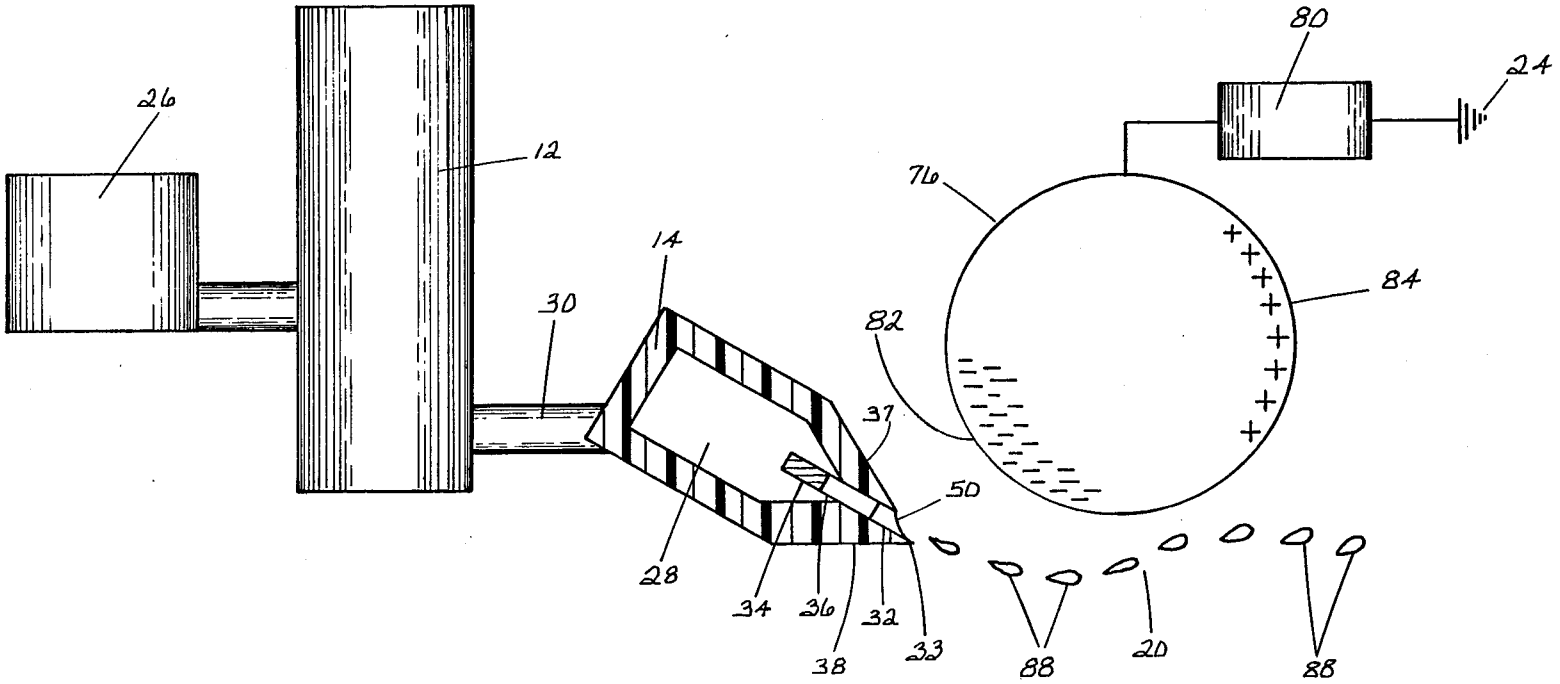
FIG. 11 is another perspective view of the nozzle of the invention shown in FIG. 1 with additional apparatus for producing droplets and diverting the droplet path.

A third method of dropletizing flow paths 20 of the invention is illustrated with reference to FIG. 11. A large diameter conductor 76 is located slightly above the trajectory of the flow paths 20 emerging from the nozzle of the invention. In FIG. 11, the nozzle illustrated is the same as that disclosed in FIGS. 1 through 5. Conductor 76 is grounded through a resistor/capacitor/inductor network 80 such that it assumes an opposite charge to the flow paths 20. In the specific embodiment illustrated, a positive charge is given to the flow paths 20 and a negative charge is given to the conductor 76. Being a large diameter member, conductor 76 distributes a large charge in the diametral region 82 near the nozzle tip 33, forcing a lessened or opposite charge towards it backside 84. As the charged flow path 20 comes into proximity of conductor 76, conductor 76 produces an attractive charge on the flow path 20 as it passes region 82, and due to inertial and gravity forces, the flow path does not impact the conductor 76. Instead, flow path 20 emerges at spaced intervals in the form of charged droplets 88.

In a specific embodiments, droplet formation is highly uniform. In utilizing a nozzle such as shown in FIGS. 6 and 7, droplets 88 were formed having a mean diameter of eighty microns with a standard deviation of three microns.

In accordance with the invention, droplets 88 may be aimed at a target, or may be kept from impact by the addition of small air flow or gravity gradient, in a particular application. Droplets of a predetermined size may be created charged and removed from the immediate nozzle area for a deposition elsewhere. Droplets may also be formed of hot melt materials and cooled to form uniform spherical particles. In specific embodiments, droplets from one micron in diameter to several hundred microns in diameter can be produced by the nozzles of the invention. Droplet size is proportional to flow path size which is controlled by slot dimension and the number of flow paths per inch as discussed herein.

Targets 22 and 72 may be of a wide variety of materials. The target may be free space, metallic, wood, paper, glass, plastics, organic materials such as plants, and food stuffs in a multitude of forms, such as webs, sheets, filaments, loose objects, etc. In general, there are no limitations as to target material or forms except when the fluid is not well charged, the target must have capacitance or grounding. In addition, operational targets have been positioned as far as four feet away from the nozzle of the invention.

Electrical characteristics of this nozzle generally restrict its use to fluids which are not highly resistive or highly conductive. As long as the liquid is somewhat resistive, i.e. not highly conductive, the nozzle is reasonably resistivity insensitive. Typical fluids might include materials whose resistivities are indicated to be respectively greater that about $1.0\times10^5$ ohm as measured by a Ransburg Probe (Model No. 6528). Only ionized water based materials are inoperative. Similarly, nozzle 10 is generally viscosity insensitive over the range of about 1 to about 20,000 centipoise.

It is understood that very small static pressures are used in this apparatus. Typical values may be under one foot of static pressure at the meniscus.

Relatively low electrical energies are also used. Very much dependent upon target and the spacing useable voltages range from 10–50 kilovolts at 300 to 60 micro amps of current, respectively. Thus, very low energies are consumed by the nozzle of the invention, for example, less than 3 watts per foot of nozzle.

In operation, nozzle 10 dispenses fluids in the form of flow paths 20 or droplets 88 in a highly controlled manner. The nozzle is mechanically simple, dimensionally accurate, reasonably non clogging and reliable. The primary mechanical basis of the nozzle is the use of a narrow slot. As discussed above, the width of the slot 32 is determined by lips 37 and 38 of the nozzle. The dimensions of slot 32 can be set with precision by selecting an appropriate shim and adjusting screws 44 and 46 and can be readily changed by the replacement of the shim 34. In addition to the shim's function determining the geometric dimensions of the nozzle slot width shim 34 serves the additional functions of determining the demensions of openings 36 and the position of openings 36 and impressing on the liquid a high electrostatic charge relative to a grounded target or sometimes a free space field.

An operational liquid meniscus 50 is formed by the low hydrostatic pressure imposed on the liquid and the geometry of nozzle lips 37 and 38. The lower lip may be serrated or smooth depending upon the application. A high surface charge on the fluid is created by the field imposed between the shim 34 and the target or free space field. The liquid meniscus 50 erupts into a plurality of ultra-small flow paths whose diameters are but a small fraction of the slot width of the nozzle. Dependent on the field strength of the target, the hydrostatic head imposed, the shim geometry, the nozzle slot dimensions and geometry, and the viscosity characteristics of the fluid, flow paths can be made to erupt at wide intervals or as close as several diameters away from each other.

Either an inward or outwardly deposed meniscus can be created by the relative position between the two lips and selection of the fluid, as discussed above. An inward meniscus intensifies the electrostatic field by virtue of its sharp exposed edge which concentrates the charge, and thus finds use when the narrowest flow path spacing is required.

For many applications, the flow path themselves are the desired end result, for example, the making of a synthetic fiber by forming flow paths of hot melts, and the lubrication of a substrate using a fine ligaments of oil.

For other applications, uniformed size highly charged droplets are the desired end product. Uses of this type would include application of agricultural pesticides or herbicides to plants, or adhesives to wood and paper products, carburation of fuels, application of chemicals to food stuffs, and the like.

While there have been described above the principles of this invention in connection with specific apparatus, it is to be clearly understood that this description is made only by way of example and not as a limitation to the scope of the invention.

What is claimed is:

1. A nozzle apparatus for electrostatically dispensing a flowable material comprising: a housing, said housing being of electrically insulative material, said housing having walls which define an interior chamber, said housing having an elongated slot therein communicating with said chamber and the exterior of said housing, said slot being resiliently compressible and expandable, the amount of compression and expansion defining the width of said slot, a shim, said shim being positioned within said chamber slot, said shim along with the amount of compression and expansion of said slot defining with precision the width of said slot, said shim being of a discontinuous geometry along its distal edge, said discontinuous geometry defining spaced openings which provide communication between said chamber and said slot.

2. The apparatus of claim 1 wherein said shim is recessed within said slot, said shim and said slot defining an exterior slot portion.

3. The apparatus of claim 2 wherein said housing on opposite sides of said slot is tapered thereby defining nozzle lips and a nozzle tip, said lips being generally symmetrical about said slot adjacent to said tip.

4. The apparatus of claim 3 wherein said chamber and said slot openings are filled with a flowable material, said flowable material in said exterior slot portion adjacent to said tip forming a meniscus, said meniscus is convex.

5. The apparatus of claim 2 wherein said housing on opposite sides of said slot is tapered thereby defining nozzle lips and a nozzle tip, said nozzle lips about said slot adjacent to said tip being asymmetrical.

6. The apparatus of claim 5 wherein said chamber and slot openings being filled with flowable material, said flowable material within said exterior slot portion adjacent to said tip forming a meniscus, said meniscus being concave, said concave meniscus defining opposite meniscus edges at which an electrical charge may be concentrated.

7. The apparatus of claim 3 wherein said lips have continuous distal edges.

8. The apparatus of claim 5 wherein one of said lips extends outwardly of said nozzle beyond the other of said lips, said other lip has a smooth distal edge and said extended lip has a discontinuous distal edge.

9. The apparatus of claim 8 wherein said one and extended lip is serrated, thereby defining spaced apart apexes.

10. The apparatus of claim 9 wherein said apexes are spaced apart from about 0.1 to about 2 inches.

11. The apparatus of 1 further comprising a fluid reservoir, said reservoir containing a flowable material, said reservoir communicating with said chamber such that said flowable material may flow into said chamber from said reservoir.

12. The apparatus of claim 1 further comprising a high voltage source, said high voltage source being electrically connected to said shim, whereby said shim and said flowable material within said housing and slot openings are electrically charged.

13. The apparatus of claim 4 further comprising a high voltage source, said high voltage source being electrically connected to said shim and said flowable material, whereby said shim and said flowable material within said housing and said slot openings are electrically charged and said meniscus erupts into a plurality of spaced flow paths of said material.

14. The apparatus of claim 6 further comprising a high voltage source, said high voltage source being electrically connected to said shim and said flowable material, whereby said shim and said flowable material within said housing and said slot openings are electrically charged and said meniscus erupts into a plurality of spaced flow paths of said material.

15. The apparatus of claim 13 further comprising an ultrasonic transducer, said transducer being affixed to said housing, said transducer causing pressure oscillations within said flowable material and forming a plurality of droplets from said flow paths.

16. The apparatus of claim 14 further comprising an ultrasonic transducer, said transducer affixed to said housing, said transducer causing pressure oscillations within said flowable material and forming a plurality of droplets from said flow paths.

17. The apparatus of claim 1 wherein said chamber has one section of generally rectangular parallelpiped configuration in cross-section and another section of a generally planar trough configuration in cross-section, said another section formed by two inclined planar surfaces, said slot extending between the distal ends of said inclined planar surfaces and said tip, said slot width being the distance between said inclined planar surfaces at their distal ends.

18. The apparatus of claim 1 wherein said chamber is generally toroidal in shape with said slot facing inwardly thereof.

19. The apparatus of claim 1 wherein said chamber slot is linear.

20. The apparatus of claim 11 wherein said fluid reservoir includes a pressure control for hydrostatically controlling the pressure of said flowable material within said nozzle chamber and said slot.

21. The apparatus of claim 1 wherein said discontinuous geometry of said shim is generally sinusoidal in shape having peaks and valleys, said spaced openings being at the valleys of said discontinuous shim geometry.

22. The apparatus of claim 1 wherein said housing is of elastomeric material and said shim is of a metallic material.

23. The apparatus of claim 1 wherein said housing further comprises means for expanding said chamber and means for contracting said chamber, whereby said slot width is precisely selectable.

24. The apparatus of claim 13 wherein said high voltage source charges said flow paths greater than the Rayleigh charge, whereby said flow paths are formed into a plurality of charged minute droplets.

25. The apparatus of claim 14 wherein said high voltage source charges said flow paths greater than the Rayleigh charge, whereby said flow paths are formed into a plurality of charged minute droplets.

26. The apparatus of claim 13 further comprising a voltage biasing means positioned adjacent said tip, said biasing means subjecting said flow paths to an electrostatic field, said electrostatic field precipitating the formation of a plurality of charged droplets from said flow paths.

27. The apparatus of claim 14 further comprising a voltage biasing means positioned adjacent said tip, said biasing means subjecting said flow paths to an electrostatic field, said electrostatic field precipitating the formation of a plurality of charged droplets from said flow paths.

28. The apparatus of claim 1 further comprising heating coils embedded in said housing walls, said coils being operatively connected to an electrical power source, said heating coils imparting heat to said housing when said power source is activated.

29. The apparatus of claim 8 wherein said discontinuous distal edge of said extended lip defines a single apex.

30. The apparatus of claim 1 further comprising at least one additional housing and a shim for each additional housing, said shim being positioned within said chamber slot of said additional housing, said housings being stacked, thereby providing a plurality of stacked nozzles.

31. The apparatus of claim 1 wherein the rate of fluid dispensed from the nozzle is a straight line function of the fluid pressure within said chamber at a selected field strength over the controlled operable range of said nozzle.

32. The apparatus of claim 1 wherein the controlled operable range of said nozzle extends about five magnitudes of pressure.

33. The apparatus of claim 12 wherein the flow characteristics of the nozzle are determined by the selection of said shim and flowable material charge and fluid pressure.

34. The apparatus of claim 12 wherein the location of said flow paths is at the concentration of said charge at said slot of said nozzle.

35. The apparatus of claim 13 wherein the spacing of said flow paths is a function of said charge and said flowable material pressure within said housing chamber and the flowable material flow through said nozzle and the configuration of said nozzle and the properties of said flowable material.

36. The apparatus of claim 1 further comprising a target spaced from said nozzle, said target being chosen from the group of materials consisting of free space, metals and metallic materials, wood, paper, glass, synthetic resins, and plastics, and plants, food stuffs, and other animal and plant and mineral materials.

37. The apparatus of claim 4 wherein said flowable material has a resistivity measured by a Ransburg Probe of greater than about $1.0\times10^5$ ohms.

38. The apparatus of claim 6 wherein said flowable material has a resistivity measured by a Ransburg Probe of greater than about $1.0\times10^5$ ohms.

39. The apparatus of claim 4 wherein said flowable material has a viscosity from about 1 to about 20,000 centapoises.

40. The apparatus of claim 6 wherein said flowable material has a viscosity from about 1 to about 20,000 centapoises.

41. The apparatus of claim 20 wherein said flowable material pressure within said chamber is from about 1 to about 5 centimeters of water.

42. The apparatus of claim 12 wherein said voltage source applies a voltage to said shim from about 10 to about 50 kilovolts at about 60 to about 300 microamps of current, respectively.

43. The apparatus of claim 12 wherein the power consumption of said nozzle is about 3 watts per foot of nozzle.

44. A method of dispensing flowable materials through a nozzle comprising introducing a flowable material into a nozzle chamber, controlling the pressure of said material within said chamber, providing a nozzle exit from said chamber, placing a metalic shim within said exit, said shim having a discontinuous distal edge at said exit, said exit being resiliently compressable and expandable, said shim and said exit defining a plurality of spaced openings providing communication between said chamber and said exit, said shim together with the amount of compression and expansion of said exit defining with precision the dimensions of said exit and said openings, said flowable material forming a meniscus about said exit, connecting said shim to a high voltage source thereby charging said flowable material and said shim, whereby said meniscus erupts into a plurality of fine flow paths extending from said nozzle.

45. The method of claim 44 further comprising imparting pressure oscillations to said flowable material within said chamber thereby forming a plurality of droplets from said flow paths.

46. The method of claim 44 further comprising charging said flowable material and said shim beyond the Rayleigh charge thereby forming a plurality of charged droplets from said flow paths.

47. The method of claim 44 further comprising placing a conductor spaced from and adjacent to said chamber exit, electrostatically biasing said conductor through a circuit network, causing said flow paths to pass adjacent to said conductor, thereby forming a plurality of charged droplets from said flow paths.

48. The method of claim 44 wherein the rate of fluid dispensed from the nozzle is a straight line function of the fluid pressure within said chamber at a selected field strength over the controlled operable range of said nozzle.

49. The method of claim 44 wherein the controlled operable range of said nozzle extends about five magnitudes of pressure.

50. The method of claim 44 wherein the flow characteristics of the nozzle are determined by the selection of said shim and flowable material charge and fluid pressure.

51. The method of claim 44 wherein the location of said flow paths is at the concentration of said charge at the tip of said nozzle.

52. The method of claim 44 wherein the spacing of said flow paths is a function of said charge and said flowable material pressure within said housing chamber and the flowable material flow through said nozzle and the configuration of said nozzle lips and the physical properties of said flowable material.

53. The method of claim 44 further comprising a target spaced from said nozzle, said target being chosen from the group of materials consisting of free space, metals and metallic materials, wood, paper, glass, synthetic resins, and plastics, and plants, food stuffs, and other animal and plant and mineral materials.

54. The method of claim 44 wherein said flowable material has a resistivity measured by a Ransburg Probe of greater than about $1.0 \times 10^5$ ohms.

55. The method of claim 44 wherein said flowable material has a viscosity from about 1 to about 20,000 centapoises.

56. The method of claim 44 wherein said flowable material pressure within said chamber is from about 1 to about 5 centimeters of water.

57. The method of claim 44 wherein said voltage source applies a voltage to said shim from about 10 to about 50 kilovolts at about 60 to about 300 microamps of current, respectively.

58. The method of claim 44 wherein the power consumption of said nozzle is about 3 watts per foot of nozzle.

* * * * *